United States Patent [19]

Lindauer et al.

[11] Patent Number: 4,876,968

[45] **Date of Patent: * Oct. 31, 1989**

[54] CONTAINER CARRYING RAILROAD CAR WITH IMPROVED SUPPORT SYSTEM

[75] Inventors: Thomas W. Lindauer, Dyer, Ind.; Richard E. Jamrozy, Lansing, Ill.

[73] Assignee: Thrall Car Manufacturing Company, Chicago Heights, Ill.

[ * ] Notice: The portion of the term of this patent subsequent to Sep. 20, 2005 has been disclaimed.

[21] Appl. No.: 197,647

[22] Filed: May 23, 1988

Related U.S. Application Data

[63] Continuation of Ser. No. 890,284, Jul. 29, 1986.

[51] Int. Cl.[4] ..... B61D 3/20; B61D 17/10

[52] U.S. Cl. ..... 105/415; 105/418; 105/419; 410/52

[58] Field of Search ..... 105/4.1, 404, 406.1, 105/411, 413, 414, 415, 416, 418, 403; 410/64, 52, 54, 56, 57, 68, 71; 296/30

[56] References Cited

U.S. PATENT DOCUMENTS 3,818,843 6/1974 Lee ..... 410/68

4,771,706 9/1988 Lindaur et al. ..... 105/415

*Primary Examiner*—Johnny D. Cherry

*Assistant Examiner*—Gary C. Hoge

*Attorney, Agent, or Firm*—Marshall, O'Toole, Gerstein, Murray & Bicknell

[57] ABSTRACT

A railroad car for carrying containers comprising a car body supported by rail trucks adapted for movement over a railroad; the car body having opposing side walls and an end wall near each end connected to the side walls with said side walls and end walls defining a well in which a container can be received; supports for the bottom of a container, when in the well, comprising a plurality of metal castings joined to each side wall; and each casting having a substantially vertical leg joined at the bottom of a side wall and an arm extending substantially horizontally inwardly toward the center of the car on which a container bottom can be supported.

6 Claims, 2 Drawing Sheets

CONTAINER CARRYING RAILROAD CAR WITH IMPROVED SUPPORT SYSTEM

This is a continuation of application Ser. No. 890,284, filed July 29, 1986.

This invention relates to railroad cars. More particularly, this invention is concerned with an improved railroad car for carrying cargo containers.

BACKGROUND OF THE INVENTION

Railroad box cars have been in use for many years transporting a wide variety of cargo. Box cars are recognized as being primarily useful when the cargo can be loaded directly in the car from a siding adjacent its production without any prior shipping involving substantial labor in loading and unloading the goods, as from a truck. The same applies at the shipping destination.

In recent years it has been found increasingly efficient to ship cargo in large containers by seal, railroad and highway. Shipping in this manner avoids unpacking the cargo between the time the container is packed by the shipper and received by the customer thereby avoiding extra labor, breakage, and theft in handling and reducing delivery time. These benefits are realized because the containers are sized and shaped to be carried by highway trucks and trailers, special railroad cars and container carrying ships.

One type of railroad car which is particularly suitable for carrying containers is referred to as a well car. Such a car has side and end walls and a partial or full floor thereby defining a well or recessed space into which one or more containers can be longitudinally positioned. The container sides are generally at least two to three times higher than the depth of the well space. Additionally, the containers can be double stacked when desired to increase the shipping load.

Well cars of the described type suitable for carrying containers, and also highway trailers, are disclosed in U.S. Pat. Nos. 4,091,742; 4,400,121; and 4,456,413.

To support a container in the well space, horizontal flanges or ledges are positioned along the bottom portions of the side walls so as to extend inwardly toward the car center. The lower side corners of the containers rest of these flanges or ledges and receive most of the container load. It has been found that container supports of the described type, which are usually fabricated of welded elements, bend and fail in use if the container lengths are such that the loads are applied other than to the corners of the well. A need accordingly exists for an improved support system for containers in well cars.

SUMMARY OF THE INVENTION

According to the invention a well car for carrying containers is provided comprising a car body supported by rail truck means adapted for movement over a railroad; the car body having opposing side walls and an end wall near each end connected to the side walls with said side walls and end walls defining a well in which a container can be received; means for supporting the bottom of a container, when in the well, comprising a plurality of metal reinforcements, such as metal castings, joined to each side wall; and with each metal reinforcement, such as a casting, having a substantially vertical leg joined at the bottom of a side wall with an arm extending substantially horizontally inwardly toward the center of the car on which a container bottom can be supported.

When containers approximately equal to the well length are carried the container and cargo load is carried primarily by supports at the end of the well. However, when shorter containers are centered in the well, the loads are carried primarily by the castings, which are able to accept such loads without failing because of their rigidity, strength and resistance to stress failure.

A casting can be located near each side wall end opposite a casting on the other side wall with a lateral cross brace connected to the arms of said opposing castings.

The car can also have a longitudinal angle member secured along the lower inner portion of each side wall and connected to the top of each casting leg and arm.

Each car side wall can have vertical braces and the leg of each casting can be joined to one of the vertical braces.

In a particularly useful form, each casting can have side flanges with outer edges and web extending between the flanges outer edges. If desired, the casting can have a central flange between the side flanges. For added strength the casting can have a solid corner or block of metal for the width of the casting where the leg and arm merge.

DETAILED DESCRIPTION OF THE DRAWINGS

To the extent it is reasonable and practical the same or similar elements or parts appearing in the various views of the drawings will be identified by the same numbers.

Figure 1:
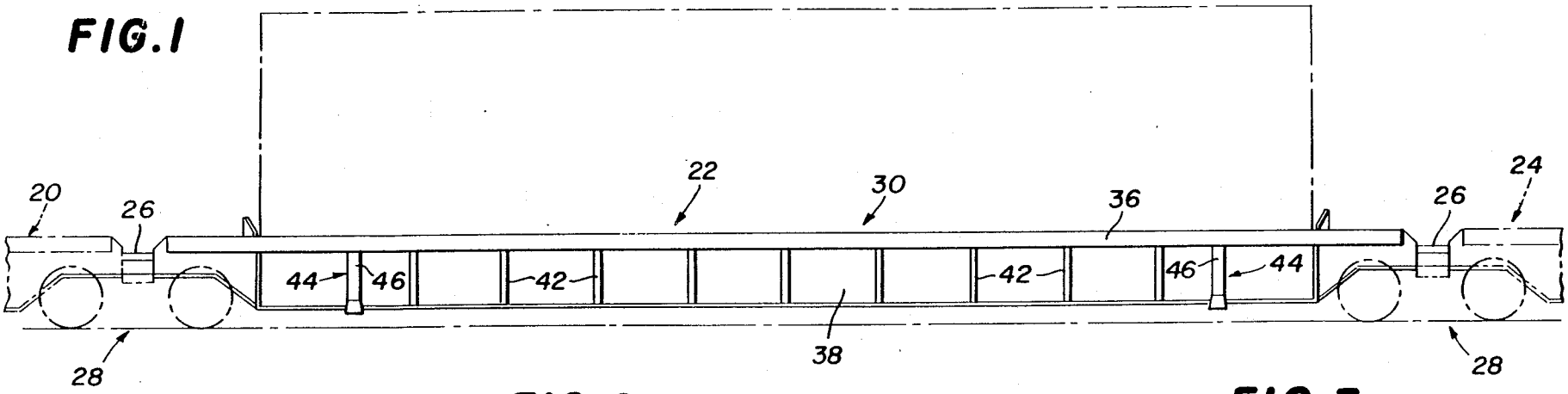
FIG. 1 is a side elevation of a well car for carrying containers according to the invention connected to similar cars at each end.
Figure 3:
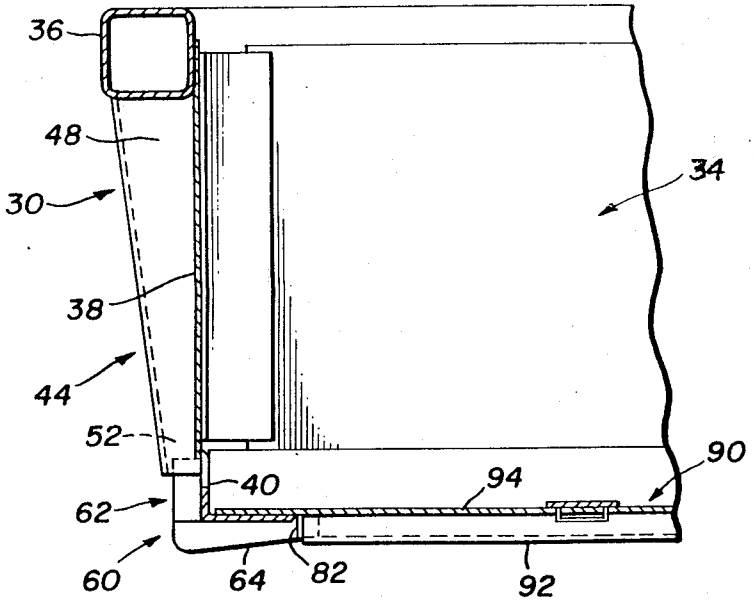
FIG. 3 is a sectional view taken along the line 3—3 of FIG. 2 showing a casting at the bottom of one well car side wall.
Figure 2:
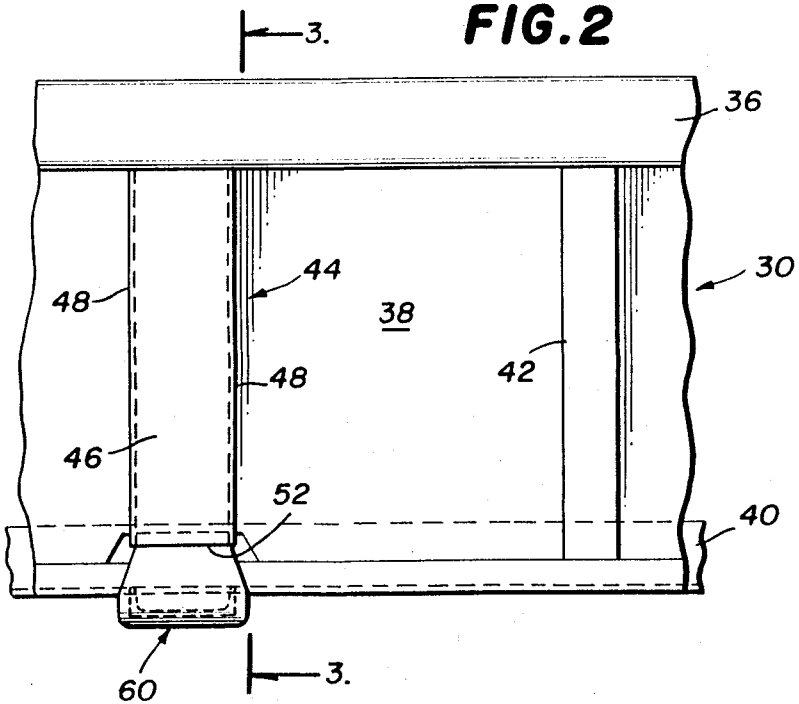
FIG. 2 is an enlarged elevational view of a side wall portion of the well car shown in FIG. 1.

With reference to FIG. 1, identical well cars 20,22,24 are connected together by a commercially available articulated connected 26 which engages the bolster of a standard two axle four wheel railroad truck 28. It is intended that the cars remain connected together as in a unit train except for repairs and maintenance. It should be understood, however, that each car can have a conventional four wheel truck at each end so that it can be transported independently and be coupled to other types of cars of a train.

Well car 22 has a pair of identical longitudinal spaced apart parallel side walls 30,32 and identical end walls 34 near each end of the car thereby defining a deep well space in which at least one cargo container can be transported. A well car of this general type is disclosed in U.S. Pat. No. 4,456,413.

Each side wall 30,32 has a tube 36 at the top. They function as major load bearing members. Additionally, each side wall 30,32 comprises a metal sheet or plate 38 extending from tube 36 downwardly and having a longitudinal horizontal angle member 40 at the bottom. The angle members 40 also function as load bearing members. A series of spaced apart vertical side wall braces 42 extend from each tube 36 to angle member 40 and are joined to plate 38.

Near each end of each side wall 30,32 is located a special vertical side brace 44 which extends from tube 36 to near the lower edge of sheet 38. The brace 44 has a front face 46 and two tapered sides 48 which are joined to sheet 38 thus forming a tapered brace having a rectangular horizontal section with an open rectangular bottom end 52.

A one piece metal casting 60 is located at the lower end of each side brace 44. The casting 60 is desirably made of cast iron or cast steel. Each casting 60 has a substantially vertically located leg 62 and a horizontal arm 64 which extends inwardly toward the center of the car. The casting 60 thus has a generally right angle shape. The upper end of leg 62 fits into the open lower end of side brace 44. The leg is welded to side brace 44 and to the bottom portion of sheet 38. The angle 40 rests on top of arm 64 and is welded to it.

Figure 7:
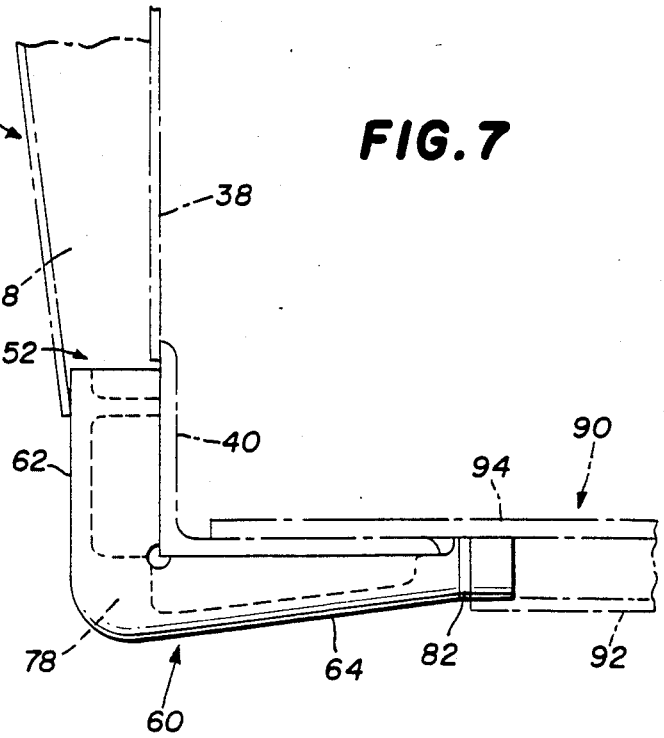
FIG. 7 is an enlarged side elevational view of the casting shown in FIGS. 4 to 6.

Each casting 60 has integral side flanges 70,72 forming the sides of the leg 62 and arm 64. Integral web 74 extends between the outer edges of flanges 70,72. A central integral flange 76 is also desirably included in both the leg and the arm. The casting 60 is generally made with a solid metal corner 78 for the width of the casting where the leg and arm merge (FIG. 7). The upper end of leg 62 of the casting 60 has a lateral horizontal flange 80 extending between side flanges 70,72. The outer end 82 of arm 64 is made of solid metal for its full width and height and is of rectangular shape in vertical section. The space between flanges 62 and 76, and 76 and 72 is hollow and with flange 80, solid metal corner 78 and solid metal end 82 defines four hollow pockets which keep the weight of the casting low.

Figure 4:
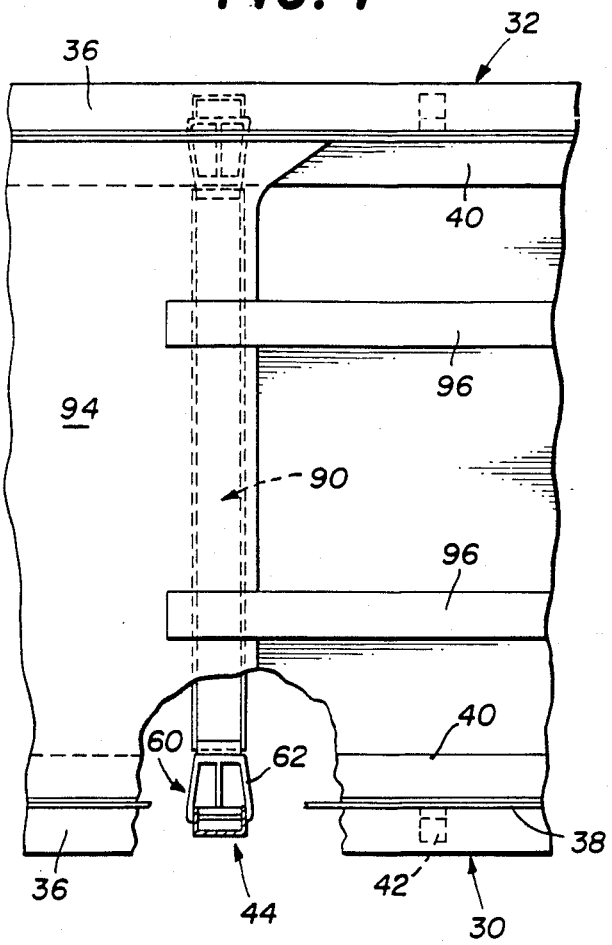
FIG. 4 is a plan view, partially in section and broken away, showing the location of opposing castings on one of the well car side walls.
Figure 5:
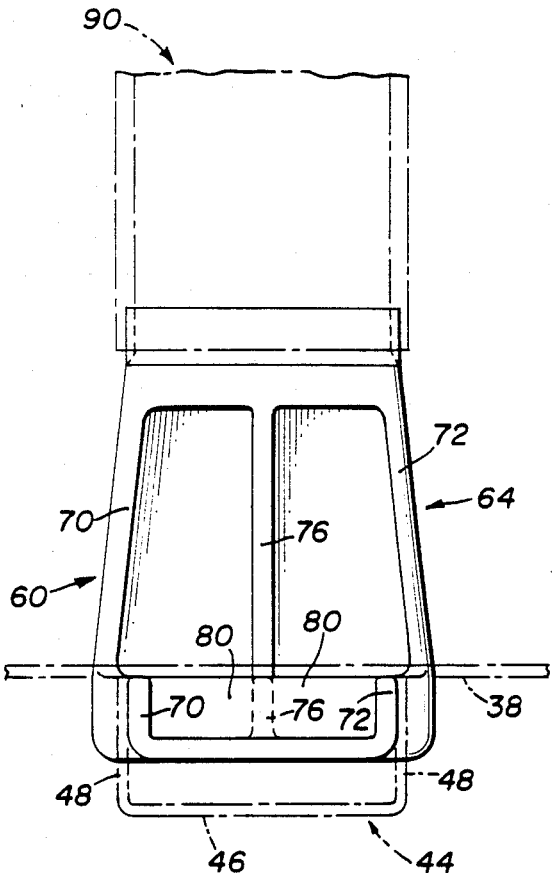
FIG. 5 is an enlarged plan view of the casting shown in FIG. 4.
Figure 6:
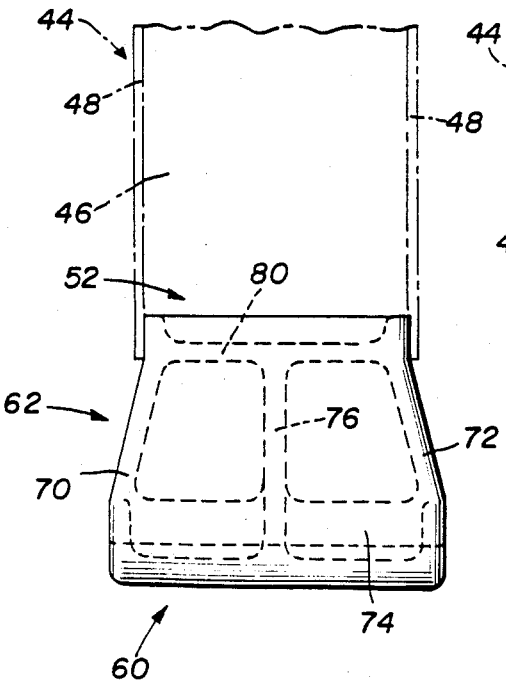
FIG. 6 is an elevational view of the casting shown in FIG. 5.

Extending between opposing castings on opposite car side walls 30,32 is a cross brace 90 consisting of a channel member 92 positioned with the channel facing upwardly. The ends 82 of the casting arms 64 nest in the adjoining end of channel member 92 and are welded thereto. Longitudinally positioned braces 96 (FIG. 4) extend for the distance between the braces 90 at each end of the car. The car contains additional floor cross braces, not shown, to which the longitudinal braces 96 are connected. Floor shear plate 94 extends from end wall 34 over the top of channel member 92 and is joined to it by welding. The longitudinal edges of plate 94 rest on and are joined to the angle members 40.

The strength and rigidity of the castings 60 provide excellent support for a heavy single container having a length shorter than the length of the well space. The concentrated load applied to each casting is readily borne without failure. Previously used transition angles used for the same purpose but fabricated from welded pieces were found in practice to develop stress cracks and fail due to the high torque moment applied to the arms on which the container was supported.

The foregoing detailed description has been given for clearness of understanding only, and no unnecessary limitations should be understood therefrom, as modifications will be obvious to those skilled in the art.

What is claimed is:

1. A railroad car for carrying containers comprising:

a car body supported by rail truck means adapted for movement over a railroad;

the car body having opposing side walls and an end wall near each end, spaced longitudinally inward of the truck means and connected to the side walls with said side walls and end walls defining a well in which a container can be received;

means for supporting the bottom of a container, when in the well, comprising a plurality of separate individual spaced metal reinforcements joined to each side wall and spaced inward of the well end walls; and each metal reinforcement having a substantially vertical leg joined at the bottom of and being entirely adjacent a side wall and the reinforcement having an arm extending laterally substantially horizontally inward toward the center of the car on which a container bottom can be supported.

2. A railroad car for carrying containers comprising:

a car body supported by rail truck means adapted for movement over a railroad;

the car body having opposing side walls and an end wall near each end, spaced longitudinally inward of the truck means and connected to the side walls with said side walls and end walls defining a well in which a container can be received;

means for supporting the bottom of a container, when in the well, comprising a plurality of separate individual spaced metal reinforcements joined to each side wall and spaced inward of the well end walls;

each metal reinforcement having a substantially vertical leg joined at the bottom of a side wall and the reinforcement having an arm extending laterally substantially horizontally inward toward the center of the car on which a container bottom can be supported; and a reinforcement located near each side wall end opposite a reinforcement on the other side wall and a lateral crossbeam operatively connected to the side walls adjacent the opposing reinforcements.

3. A railroad car according to claim 2 including a longitudinal angle member secured along the lower inner portion of each side wall and supported above and by each of the reinforcement arms.

4. A railroad car for carrying containers comprising:

a car body supported by rail truck means adapted for movement over a railroad;

the car body having opposing side walls and an end wall near each end, spaced longitudinally inward of the truck means and connected to the side walls with said side walls and end walls defining a well in which a container can be received;

means for supporting the bottom of a container, when in the well, comprising a plurality of separate individual metal reinforcements joined to each side wall and spaced inward of the well end walls;

each metal reinforcement having a substantially vertical leg joined at the bottom of and being entirely adjacent a side wall and an arm extending substantially horizontally inward toward the center of the car on which a container bottom can be supported; and the reinforcement leg and arm merging integrally into a unitary corner of metal for the width of the reinforcement where the leg and arm merge.

5. A railroad car for carrying containers comprising:

a car body supported by rail truck means adapted for movement over a railroad;

the car body having opposing side walls and an end wall near each end, spaced longitudinally inward of the truck means and connected to the side walls with said side walls and end walls defining a well in which a container can be received;

means for supporting the bottom of a container, when in the well, comprising a plurality of separate individual spaced metal reinforcements joined to each side wall and spaced inward of the well end walls;

each metal reinforcement having a substantially vertical leg joined at the bottom of a side wall and the reinforcement having an arm extending laterally substantially horizontally inward toward the center of the car on which a container bottom can be supported;

a longitudinal horizontal structural angle member having a vertical flange and a horizontal flange extending along the bottom of each side wall with the vertical flange joined to the side wall; and with the structural angle member horizontal flange supported by the arms of at least two spaced apart reinforcements.

6. A railroad car for carrying containers comprising:

a car body supported by rail truck means adapted for movement over a railroad;

the car body having opposing side walls and an end wall near each end, spaced longitudinally inward of the truck means and connected to the side walls with said side walls and end walls defining a well in which a container can be received;

means for supporting the bottom of a container, when in the well, comprising a plurality of separate individual spaced metal reinforcements joined to each side wall and spaced inward of the well end walls;

each metal reinforcement having a substantially vertical leg joined at the bottom of a side wall and the reinforcement having an arm extending laterally substantially horizontally inward toward the center of the car on which a container bottom can be supported; and each side wall having vertical braces and the leg of each reinforcement being joined to the side wall at one of the vertical braces.

* * * * *